United States Patent [19]

Schulte et al.

[11] 4,333,278

[45] Jun. 8, 1982

[54] BLADED CENTRIFUGAL BLASTING WHEEL

[75] Inventors: Harold F. Schulte, Mishawaka; Raymond M. Leliaert; Robert D. Rohr, both of South Bend, all of Ind.

[73] Assignee: Wheelabrator-Frye Inc., Hampton, N.H.

[21] Appl. No.: 78,478

[22] Filed: Sep. 24, 1979

[51] Int. Cl.[3] ..... B24C 5/06

[52] U.S. Cl. ..... 51/434; 51/435

[58] Field of Search ..... 51/431, 432, 433, 434, 51/435; 241/275; 416/214 R, 214 A, 220 R, 220 A

[56] References Cited

U.S. PATENT DOCUMENTS

| | | | |
|---|---|---|---|
| 1,052,291 | 2/1913 | Smoct | 51/435 |
| 2,077,638 | 4/1937 | Minich | 51/434 |
| 2,212,451 | 8/1940 | Peik | 51/434 |
| 2,732,666 | 1/1956 | Powell | 51/431 |
| 2,869,289 | 1/1959 | Gossard | 51/435 |
| 3,785,105 | 1/1974 | Freeman | 51/435 |
| 4,069,025 | 1/1978 | Macmillan | 51/434 |
| 4,176,502 | 12/1979 | Leliaert | 51/435 |
| 4,203,263 | 5/1980 | Fiala | 51/434 |
| 4,207,712 | 6/1980 | Toedtli | 51/435 |

*Primary Examiner*—Nicholas P. Godici

*Attorney, Agent, or Firm*—McDougall, Hersh & Scott

[57] ABSTRACT

A bladed centrifugal blasting wheel formed of a pair of spaced parallel wheel plates having a central opening through which blades are inserted into grooves extending radially from the central opening through the adjacent surfaces of the wheel plates, improvements including means for locking the blades between the wheel plates, impeller and control cage means for feeding particulate material onto the ends of the blades with centering means forming a part of the impeller for locating the elements in the central opening, resilient means adapted to be engaged by the blades upon insertion for holding the inserted blades during assembly, indicator means for showing the position of the control cage and means for providing air curtain to prevent accumulation of stray or rebound abrasive in the hub seal area during rotation of the bladed wheel.

10 Claims, 17 Drawing Figures

BLADED CENTRIFUGAL BLASTING WHEEL

This invention relates to bladed wheels whereby particulate material is thrown with centrifugal force from the ends of the blades onto an object or surface to be abraded, cleaned, or otherwise engaged by the particulate material for surface treatment.

Airless centrifugal throwing wheels of the type described are marketed by Wheelabrator-Frye Inc. under the trademark WHEELABRATOR. Such wheels consist of a pair of spaced parallel side plates having a number of blades extending radially between the plates in equally circumferentially spaced apart relation, with means removably securing the blades between the plates. Means are provided for rotating the bladed wheel at high speed about a central axis and for depositing particulate material onto the inner end portions of the blades whereby the particulate material is displaced by centrifugal force outwardly over the surface of the blades and projected at high velocity from the ends of the blades. Means, such as an impeller, is provided in the central opening for feeding the particulate material onto the inner ends of the blades, with a stationary control cage surrounding the impeller for controlling the passage of particulate material to the blades thereby controlling the direction as well as the blast pattern of the particulate material thrown from the ends of the blades.

It is an object of this invention to provide a bladed wheel of the type described which embodies numerous improvements in the construction and in the assembly of such wheel and in parts of which it is formed, including improvements in the blades per se, which enables utilization of both surfaces of the blades thereby to enable the wheel to be rotated at high speed in either direction for universal operation as a right hand or left hand wheel; which embodies means for center insertion and removal of the blades with improved locking of the blades in position of use between the plates; which includes means for insertion of the blades through the central opening between the plates; which embodies means for interrelating the impeller with the blades for precise timing therebetween; which embodies means for positioning the control cage and for maintaining the setting of the control cage for control of the blast pattern; which embodies means for keeping the hub seal area free of particulate material thereby to enhance the sealed relation and the useful life of the seal; and which makes use of a control cage with a ring seal that is effective to decrease wear on the inner ends of the blades resulting from abrasion of particulate material and dust induced through the gap between the cage and the front wheel plates.

These and other objectives and advantages of this invention will hereinafter appear and for purposes of illustration, but not of limitation, an embodiment of the invention is shown in the attached drawings in which.

Figure 1:
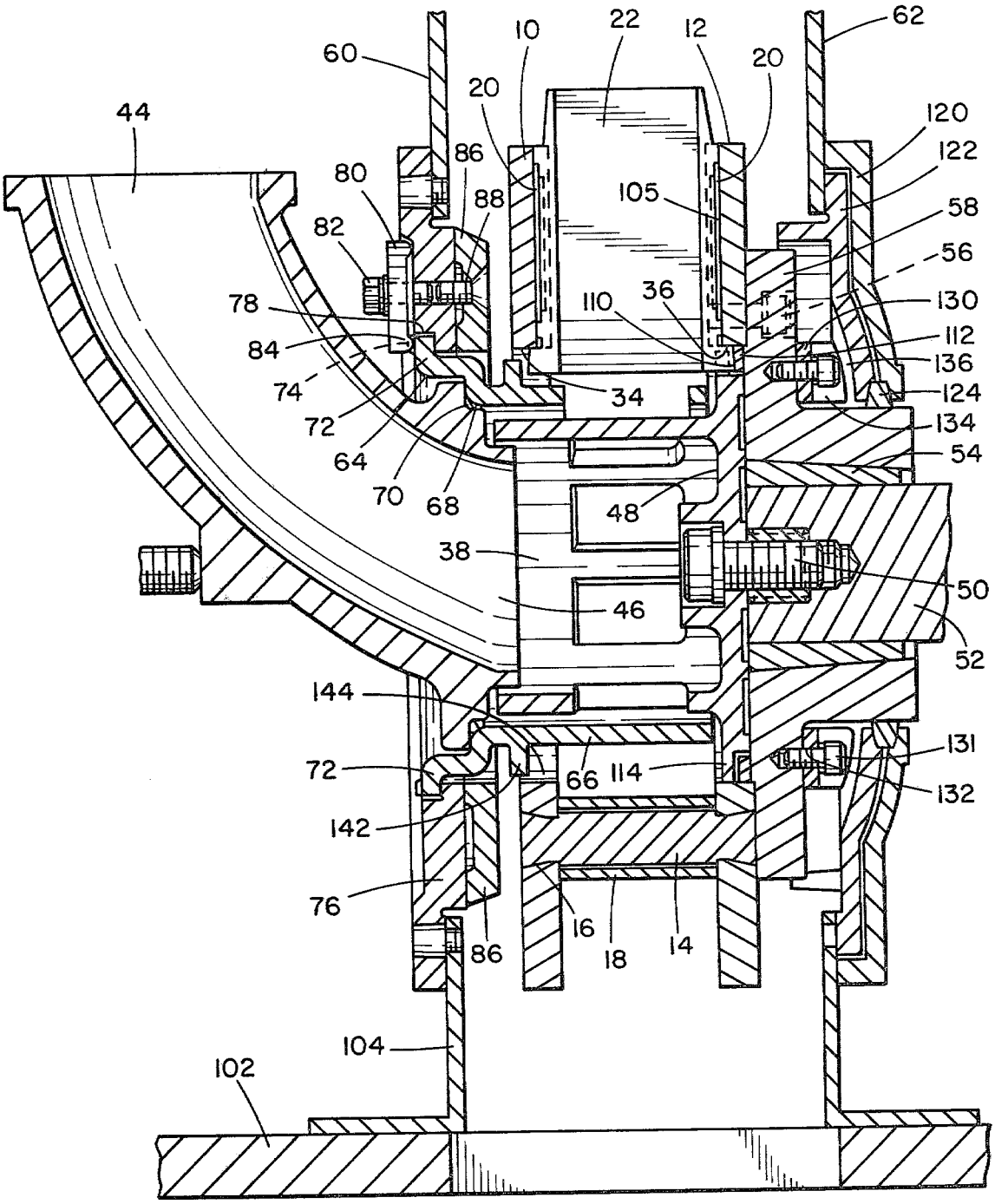
FIG. 1 is a sectional elevational view of the bladed wheel embodying the features of this invention.
Figure 2:
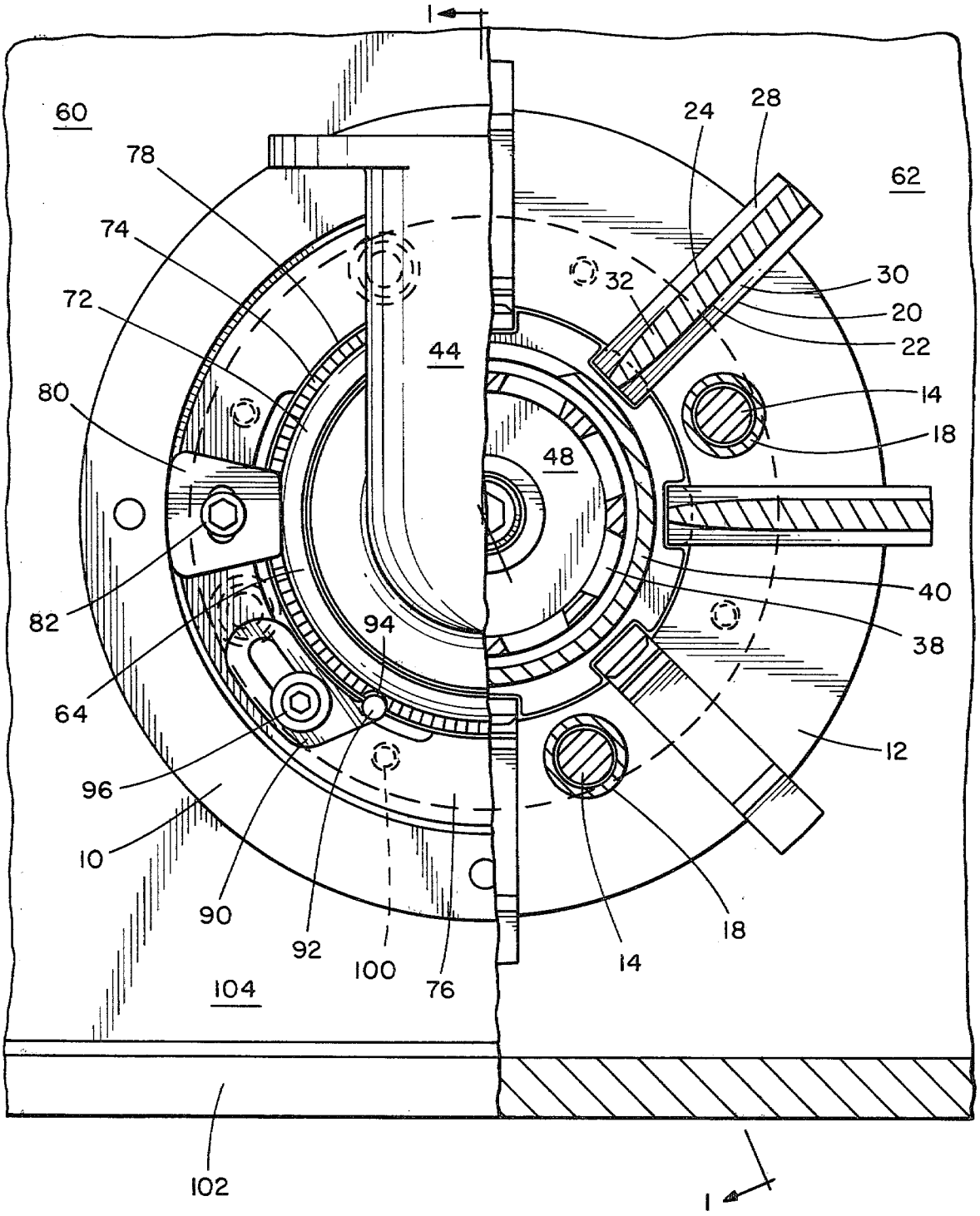
FIG. 2 is a frontal view partially in section of the bladed wheel shown in FIG. 1.
Figure 3:
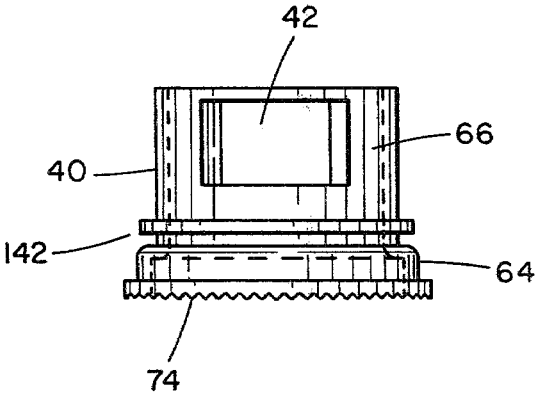
FIG. 3 is an elevational view of the control cage.
Figure 4:
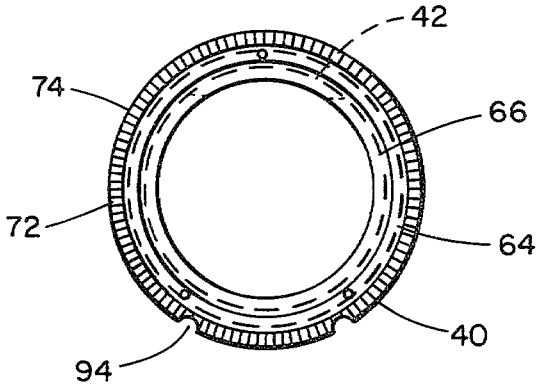
FIG. 4 is an end view of the control cage shown in FIG. 3.
Figure 6:
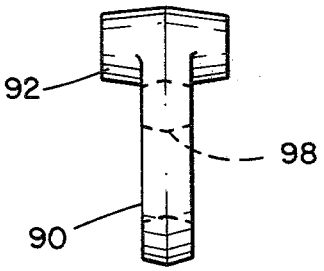
FIG. 6 is an end elevational view of the indicator of FIG. 5.
Figure 5:
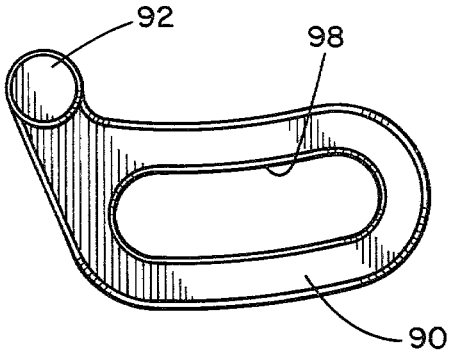
FIG. 5 is a top plan view of the indicator for the control cage.
Figure 7:
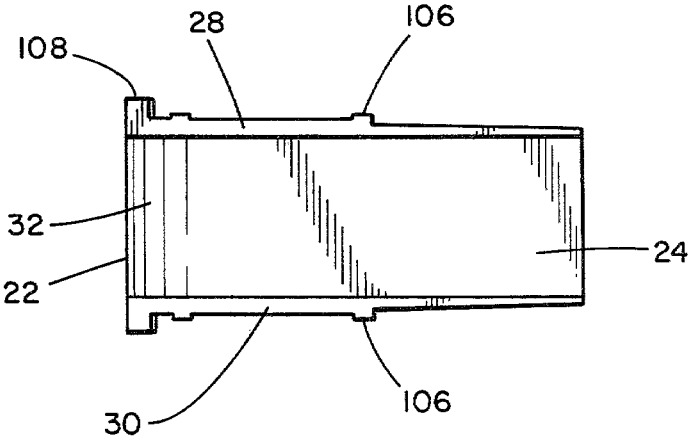
FIG. 7 is a top plan view of a blade member embodying the features of this invention.
Figure 8:
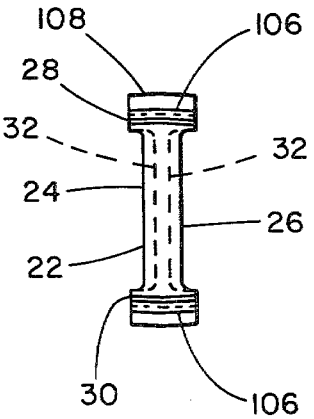
FIG. 8 is an end view of the blade member shown in FIG. 7.
Figure 9:
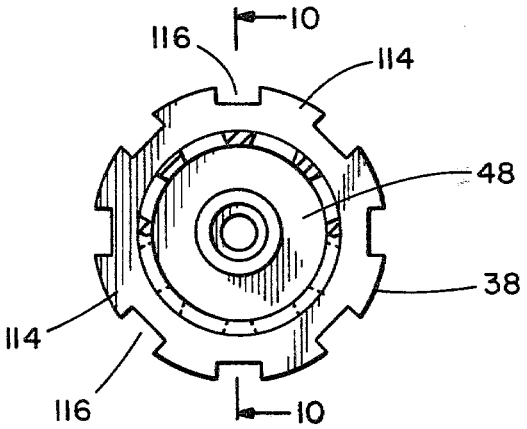
FIG. 9 is a sectional end elevational view of the impeller embodying features of this invention.
Figure 10:
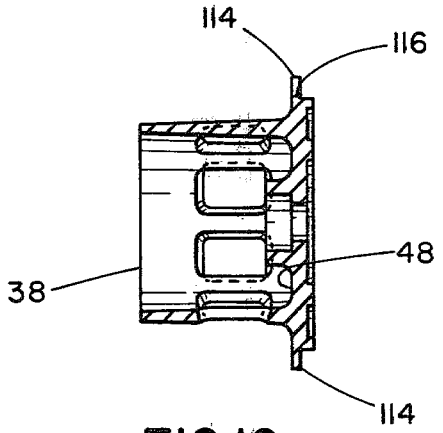
FIG. 10 is a side sectional elevational view of the impeller shown in FIG. 9.

Referring now to the drawings; the wheel is formed of a pair of disc plates hereinafter referred to as a front plate 10 and a back plate 12 secured one to the other in spaced apart relation by circumferentially spaced apart spacers 14 which extend through laterally aligned openings 16 in the front and back plates 10 and 12. The portion of each spacer extending between the plates is protected by a sleeve 18 formed of hard, wear-resistant material and dimensioned to have a length corresponding to the spaced relation between the plates 10 and 12 and having an inner diameter which is slightly greater than the outer diameter of the spacer 14 and an outer diameter greater than the diameter of the opening 16 so as to extend in the area between the front and back plates immediately surrounding the openings 16.

The front and back plates 10 and 12 are formed with crosswise aligned pairs of radially extending slots 20 spaced circumferentially along the inner walls of the plates for the receipt of blades 22, each of which is formed with two faces 24 and 26, dimensioned to have a width approximately equal to the distance between the plates and integral lateral edge portions 28 and 30 which extend above and below the faces and are dimensioned slidably to be received in the aligned slots 20 for supporting the blades in mounted relation between the wheel plates 10 and 12. The two faces 24 and 26 of the blades are flat with the inner end portions being formed of diminishing cross section to provide a slight curvature 32 from the inner end outwardly for receipt of particulate material with a minimum of abrasive wear.

The front and back plates 10 and 12 are formed with central openings 34 and 36 to define a circular section in which a vaned impeller 38 of cylindrical shape is received for rotational movement with the wheel plates. The vaned impeller 38 has an outside diameter dimensioned to be less than the diameter of the central opening in the front plate to define an annular space therebetween for receipt of a fixed control cage 40 of cylindrical shape having one or more lengthwise extending slots 42 through which material is fed by the impeller 38 onto the inner ends 32 of the blades 22 during rotational movement.

A feed spout 44 is mounted at an upward incline with the outlet opening 46 at the lower end in endwise alignment with the central opening of the cylindrical impeller and in slight telescoping relation therewith for feeding particulate material into the interior of the impeller.

The impeller is formed with a back face 48 which is connected by means of a lock bolt 50 onto a shaft 52 supported by bearings for rotational movement, as by suitable driving means (not shown) such as a belt, gear or other indirect drive or directly driven by an electrical motor or the like. The back wheel plate 12 is in turn bolted (56) onto a hub 58 connected with a tapered lock bushing 54 with the shaft 52 for rotational movement therewith.

The wheel is protected by a guard housing having fixed front and back guard plates 60 and 62 in spaced parallel relation with the wheel plates to project beyond the outer ends therewith.

In operation, the impeller 38 and the bladed wheel plates 10 and 12 are rotated at high speed in one direction about the central axis. Particulate material is fed from the feed spout 44 into the interior of the impeller 38 from which it is dispensed radially through slot in the stationary control cage 40 onto the inner ends of the blades 22. Responsive to the centrifugal forces operating on the particulate material during rapid rotational movement of the wheel, the particulate material is displaced outwardly over the face of the blades, with increasing velocity, until thrown at high speed, from the ends of the blades. Because of the construction of the blades with substantially identical front and back faces, the direction of rotation of the wheel can be reversed whereby the opposite face becomes the face over which the particulate material travels during the blast cycle thereby to eliminate the need for separate right hand and left hand wheels.

By selectively positioning the slot 42 of the control cage 40 through which the particulate material is projected by the impeller 38, it is possible narrowly to define the sector from which the particulate material is thrown centrifugally from the ends of the blades thereby to concentrate the particulate material while controlling the blast pattern and the direction at which the particulate material is thrown centrifugally from the ends of the blades.

For this purpose, the control cage is mounted for rotation relative to the impeller 38 and the wheel plates 10 and 12 to the desired position of adjustment, and means are provided for releasably clamping the control cage to maintain the control cage in the adjusted position. As illustrated in the drawings, the control cage is formed with an annular flanged portion 64 extending outwardly from the forward edge of the cylindrical section 66 including an annular inner elbow portion 68 with rides on an adjacent portion of the feed spout 44 with a ring seal 70 in between, and an annular outwardly extending rim portion 72 formed with serrations 74 or rack teeth on the outer face. The control cage is supported for rotational movement to an adjustable fixed position by a control cage adapter plate 76 having an annular slot 78 in its inner face dimensioned to receive the annular rim end portion 72 of the control cage.

The control cage 40 is locked in its adjusted position by one or more clamping means including clamp 80 adapted releasably to be secured to the adapter plate 76, as by means of a nut and bolt arrangement 82 which extends through aligned openings in the clamp 80 and adapter 76, with one or more projections 84 extending outwardly from an end portion of the clamping member 80 in endwise alignment with the serrated edge 74 of the control cage for engagement therewith releasably to interlock the control cage with the stationary control cage adapter. A liner 86, in the form of a ring member of an abrasive resistant metal, is secured to the inner face of the adapter 76 for the protection thereof. The liner is formed with openings 88 in registry with the clamp openings through the adapter releasably to secure the liner to the inner face of the adapter by the same fastening means 82 securing the clamping member to the front face of the adapter.

Means are provided, in accordance with the practice of this invention, for indicating the position of any adjustment of the control cage throughout the full 360° range. For this purpose, there is provided an indicator plate 90 in the form of a flat reversible plate adapted releasably to be secured to the front face of the control cage adapter 76 offset from the clamping means, with the indicator plate having a portion 92 projecting inwardly beyond the inner edge of the adapter plate, with abutments which are adapted to seat within a notch 94 provided in the rim end portion of the control cage. The indicator plate is releasably secured to the front face of the adapter, as by nut and bolt means 96, which extend through aligned openings in the adapter and indicator plate, with the opening 98 in the indicator plate being in the form of an elongate slot having a curvature along a circle the axis of which corresponds to the central axis of the control cage. Thus the indicator is able to follow the rotational adjustment of the control cage to the extent limited by the curvilinear slot 98. Additional circumferentially spaced apart openings 100 are provided in the adapter for movement of the indicator plate from one section to another, which together with the reversibility of the indicator plate, permits rotational movement of the control cage beyond the point limited by the curvilinear slot.

The control cage adapter is marked with indications to identify the position of the control cage and the fastening means serve to maintain the position of the control cage in the adjusted position. The control cage adapter is positioned to locate and support the outer periphery of the control cage and is secured in position of use to a base plate 102 or to the front of the wheel guard housing 104.

While the blades 22 can be dimensioned to have a length corresponding to the distance between the inner and outer peripheries of the wheel plates 10 and 12 so as to be confined between the plates, it is preferred to make use of blades dimensioned to have a length greater than the distance between the inner and outer peripheries of the wheel plates so that the blades will extend free of the plates for a substantial distance beyond their outer peripheries. The blades are dimensioned to have a length to enable the blades to be inserted through the central opening 34 into the crosswise aligned pairs of grooves for endwise displacement radially until stopped when the blades reach their assembled relation in the wheel.

Wheels and blades adapted for internal insertion of the blades through the central opening are described in U.S. Pat. No. 3,683,556 issued Aug. 15, 1972 and entitled "Centrifugal Blasting Wheel". In accordance with the practice of this invention, improvements are provided in the construction of the blades and in the wheels whereby the blades are locked in position of use in the wheel while permitting easy insertion and removal for replacement and repair and whereby the blades are held in position of use in a manner to prevent displacement by gravitational force until all of the blades have been assembled in position of use thereby to enhance the assembly.

As illustrated in the drawings, the blades are a one piece casting of rectangular shape and with a cross section in the form of an I with the lateral side flanges 28 and 30 dimensioned to correspond with the width of the slots 20 to be received in sliding engagement within the slots and with the flat body portions 24 and 26 of the blades spanning the space between the wheel plates 10 and 12. As previously described, the flat body portions 24 and 26 are formed with upper and lower smooth faces of substantially the same shape for enabling either side to represent the throwing surface over which the particulate material is displaced by centrifugal force. The inner end portions 32 of the blades are turned inwardly curvilinearly for minimizing wear on the blades where the blades are engaged by particulate material delivered from the impeller.

As illustrated in the drawings, the blades 22 are dimensioned to have a width from side flange to side flange which is slightly less than the distance between the base portions of the crosswise aligned grooves, so as to provide a spaced relation 105 therebetween whereby particulate material that becomes lodged between the blades and the wheel plates can be received greatly to enhance the ease by which the blades can be displaced into and out of position of use. Locating abutments 106 extend laterally from longitudinally spaced portions of the side walls for a distance slidably to engage the base of the locating grooves thereby firmly to center the blades in the assembled relation between the wheel plates.

The means for stopping radial displacement of the blades upon reaching their assembled position between the wheel plates comprises lugs 108 which extend laterally from the inner end portions of the blades for a distance greater than the distance between the bases of the crosswise aligned grooves so that the lugs will engage the inner periphery of the wheel plates when the blades are in their assembled relation. This provides for centrifugal loading of the blades, whereby centrifugal forces operating on the blades during rotational movement of the wheel in either direction will cause the blades to seek their assembled relation defined by engagement of the lugs 108 with the inner periphery of the wheel plates.

One of the problems encountered when assembly is effected by central insertion of the blades resides in the effect of gravitational forces on the blades whereby inserted blades in the upper segment tend to slip from their grooves during insertion of the remainder of the blades or until the impeller is inserted in position of use to occupy the central opening.

For this purpose, the lugs 108 are dimensioned to extend laterally beyond the base of the crosswise aligned blade receiving grooves but less than the distance between the outer walls of the wheel plates to provide a recessed portion 110 about the lateral edges of the lugs in which the recessed portion defines a cylindrical section adapted to receive a ring member 112 of resilient material which, in the seated relation, resiliently engages the lug portion of the inserted blades to retain the blades in their assembled relation until the impeller has been inserted into position of use within the opening. As illustrated in FIG. 1 of the drawings, the retention ring 112 is trapezoidal in cross section with the inner surface tapered to conform with an opposite taper in the outer edge of the blade lugs whereby the tapered edges provide a cam action which depresses the adjacent ring portion for wedging engagement between the tapered surfaces as the blade is inserted into position of use. The desired retention can also be obtained by use of a ring member of resilient material which deforms on engagement to establish a wedging action.

Since the inner ends of the blades extend beyond the inner periphery of the wheel plates, the cylindrical section of the control cage is dimensioned to have an outer diameter which is less than the diameter of the circular path defined by the inner ends of the assembled blades but greater than the outer diameter of the impeller so as to be received in the annular space defined between the blade ends and the impeller.

It is important for the vanes of the impeller to rotate in time with the blades for feeding the particulate material in timed relation therewith. This is effected in a simple, efficient and positive manner, in accordance with an important concept of this invention, by providing the impeller 38 with an annular flange 114 that extends outwardly from the back wall portion for a distance greater than the radius of the circle formed by the ends of the blades but less than the inner periphery of the central opening in the back wheel plate. The annular flange 114 is formed with circumferentially spaced slots 116 corresponding in number and in space with the number of blades, with the slots dimensioned to have a width slightly greater than the thickness of the lugs 108 on the inner ends of the blades so that, after the blades are in place, the impeller can be inserted axially through the central opening with the inner ends of the blades aligned with the slots for passage therethrough whereby, when in the assembled relation, the inner end portions of the lugs adjacent the back wheel plate are embraced by the annular centering flange 114. Thus the wheel plates operatively engage the impeller to drive the impeller in timed relation with the blades.

In the past, problems have been raised from the accumulation of abrasive particles and dust in the hub seal area, i.e. the area between the rotating hub and the right and left hand hub seals 120 and 122 respectively extending between the guard housing 62 and the hub 58 with a felt pad 124 in between.

Figure 11:
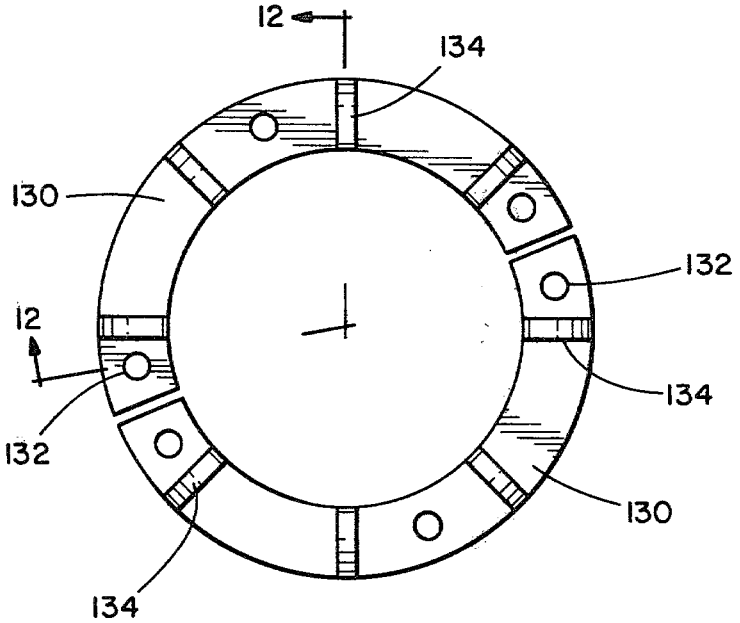
FIG. 11 is an elevational view of the flinger ring.
Figure 12:
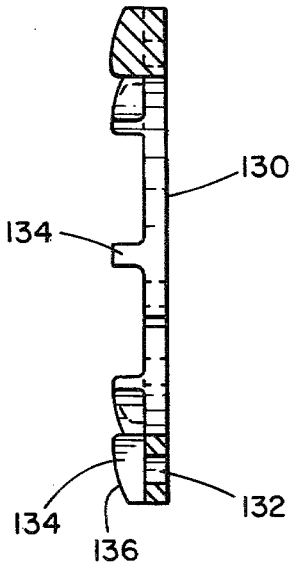
FIG. 12 is an end view partially in section of the flinger ring shown in FIG. 11.
Figure 13:
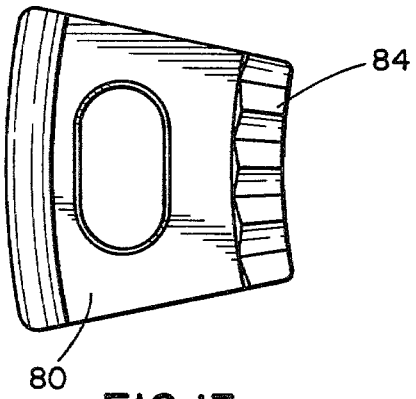
FIG. 13 is a top plan view of the control cage clamp.
Figure 14:
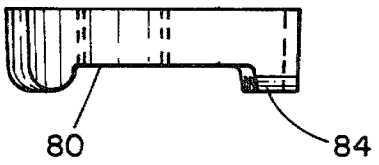
FIG. 14 is a side elevational view of the clamp shown in FIG. 13.

In accordance with a further improvement in the wheel assembly of this invention, means are provided for keeping the hub seal area relatively free of abrasive and dust. Such means operate for displacement by a blowing action created in response to turning movement of the hub and wheel plates attached thereto. The described blowing effect is created by a flinger in the form of a ring member 130 attached to the outer face of the hub flange 58 by way of bolts 131 through holes 132 with circumferentially spaced apart fan blades 134 extending rearwardly from the back face of the flinger ring member. As shown in FIGS. 11 and 12, the fan blades 134 extend rearwardly substantially perpendicularly from the rear face of the ring with an outer curvilinear edge 136 decreasing in dimension from the inner end.

Figure 15:
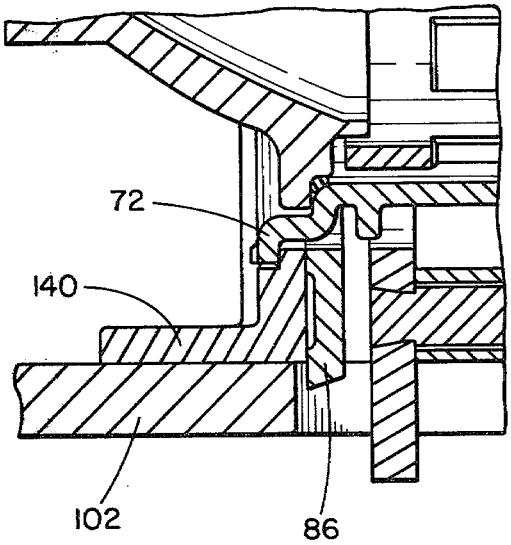
FIG. 15 is a partial view showing the mounting of the adapter onto the base plate when use is made of an indirect drive.
Figure 16:
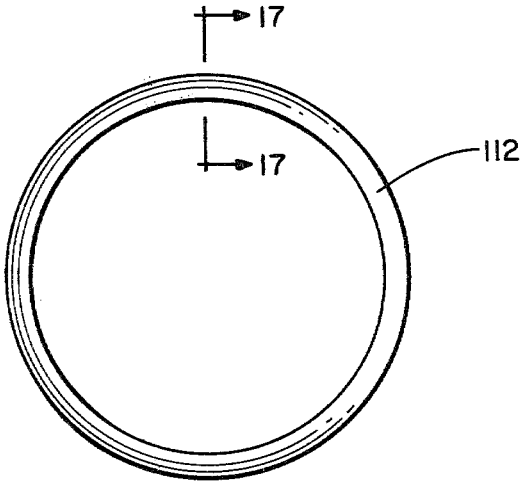
FIG. 16 is a plan view of the retention ring.
Figure 17:
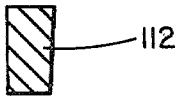
FIG. 17 is a cross sectional view of the retention ring.

The modification shown in FIG. 1 of the drawings is for a wheel that is directly driven and wherein the axis of the wheel is a greater distance from the base plate 102 to accommodate the backing of the electrical motor (not shown). This greater distance permits the use of a full circle control cage adapter 76, mounted on the front wall of the guard housing 104. When use is made of an indirect drive, the axis of the wheel can be a lesser distance from the supporting base plate 102, as shown in FIG. 15. In such event, a full circle adapter 76 is not used and a base mounted adapter 140 is used.

In a further ramification, shown in FIG. 1, the control cage 66 is formed with an annular flange 142 extending outwardly as a ring on the end portion adjacent the feed spout 44 and in radial alignment with the outer portion of the front plate 10 so as to fill the gap 144 between the nominal outside diameter of the cage and the inside diameter of the front wheel plate 10. The ring-flange 142 operates to minimize the induction of air through the gap 144 which when otherwise present tends to pick up stray and rebounding abrasive particles which blast the inner ends of the blades and the adjacent ends of the front wheel plate.

It will be understood that changes may be made in the details of construction, arrangement and operation, without departing from the spirit of the invention, especially as defined in the following claims.

We claim:

1. In a bladed centrifugal blasting wheel, a pair of front and back wheel plates interconnected in spaced parallel relation with each wheel plate having a central opening defined by inner peripheral surfaces of the wheel plates, a plurality of crosswise aligned grooves in the inner faces of said front and back wheel plates extending radially in equally circumferentially spaced apart relation from the inner peripheral surfaces of the wheel plates to their outer edges, a blade for each pair of aligned grooves dimensioned to have a width slidably to be received between said pair of crosswise aligned grooves and dimensioned to have a length to enable insertion into said crosswise aligned grooves through said central opening, means releasably holding the blades within said crosswise aligned grooves when in position of use between said front and back wheel plates, said means comprising lugs extending laterally from the opposite sides of the inner end portion of the blade for a distance to extend beyond the inner ends of the grooves whereby the inner peripheral surface of the plates, adjacent the grooves, lies in the path of the lugs to prevent displacement of the blade beyond engagement between the lugs and the plates when the blades are inserted in position of use, an impeller in the form of a vaned cylindrical member mounted within the central opening, flange means extending radially outwardly from the impeller for a distance less than the central opening but more than the distance between the central opening less the length of the blade lugs, and slots in the outer ends of said flange means dimensioned to receive portions of said blade lugs extending inwardly beyond the inner ends of the grooves to interlock the impeller and the blades to maintain registry therebetween.

2. A centrifugal blasting wheel as claimed in claim 1 in which said blades being of I configuration with lateral edge flanges dimensioned slidably to be received within the crosswise aligned grooves and in which the flanged lateral edge portions of the blades are spaced one from the other by an amount less than the spaced relation between the bases of the crosswise aligned grooves thereby to provide space between the flanged edge portions and the base of the grooves, and which include abutments extending laterally from the longitudinally spaced apart portions of the flanged members which extend substantially into engagement with the base of the grooves to stabilize the blade between the wheel plates while leaving a spaced relation between the abutments for the collection of stray particulates therein.

3. A centrifugal blasting wheel as claimed in claim 1 in which said flange means comprises a ring member in which the slots are in the outer ends thereof in circumferentially spaced apart relation corresponding to the pairs of grooves in the wheel plates.

4. In a bladed centrifugal blasting wheel, a pair of front and back wheel plates interconnected in spaced parallel relation with each wheel plate having a central opening, a plurality of crosswise aligned grooves in the inner faces of said front and back wheel plates extending radially in equally circumferentially spaced apart relation from the central opening, a blade for each pair of aligned grooves dimensioned to have a width slidably to be received between said pair of crosswise aligned grooves and dimensioned to have a length to enable insertion into said crosswise aligned grooves through said central opening, means releasably holding the blades within said crosswise aligned grooves when in position of use between said front and back wheel plates, said means comprising lugs extending laterally from the inner end portions of the blades for a distance greater than the spaced relation between the bases at their inner ends of the crosswise aligned grooves whereby the lugs engage the inner peripheral surfaces of the front and back plates adjacent the grooves when the blades are inserted in position of use, means for retaining the blades to prevent displacement by gravitational force during the assembly between the wheel plates comprising a ring member of resilient material having an outside diameter corresponding to the diameter of the central opening and positioned in the opening resiliently to be engaged by the outer edge of a lug when the blade is inserted into position of use for support of the blades which have been inserted during assembly.

5. A centrifugal blasting wheel as claimed in claim 4 in which the inner face of the ring and the outer edge of the lugs are oppositely tapered for resilient engagement upon insertion of the blade.

6. In a bladed centrifugal blasting wheel, a pair of front and back wheel plates interconnected in spaced parallel relation with each wheel plate having a central opening, a plurality of crosswise aligned grooves in the inner faces of said front and back wheel plates extending radially in equally circumferentially spaced apart relation from the central opening, a blade for each pair of aligned grooves dimensioned to have a width slidably to be received between said pair of crosswise aligned grooves and dimensioned to have a length to enable insertion into said crosswise aligned grooves through said central opening, means releasably holding the blades within said crosswise aligned grooves when in position of use between said front and back wheel plates, an impeller in the form of a vaned cylindrical member mounted within the central opening for rotational movement with the wheel plates, a stationary control cage in the form of a cylindrical section extending into the central opening between the impeller and the wheel plates, at least one feed slot through the cylindrical section through which particulate material is displaced from the impeller onto the inner ends of the blades, and means for mounting the control cage for rotational movement to adjust the position of the feed slot, means for locking the control cage in the adjusted position, indicator means for indicating the position of the control cage, and means for feeding particulate material to the interior of the impeller, in which the means for locking the control cage in the adjusted position comprises a fixed adapter plate having an inner annular groove, said control cage having an outer radially extending annular ring member received within said ring groove, and a latching plate releasably secured to the adapter plate with a portion overlapping the ring member for interengagement therewith, said indicator means including a reversible and rotatably adjustable indicator plate and fastening means for adjustably and releasably securing either side of the indicator plate to the adapter plate.

7. A centrifugal blasting wheel as claimed in claim 6 in which the reversible indicator plate overlies the adapter plate and has a curvilinear slot, with its center corresponding with the axis of the control cage, the fastening means extending through the curvilinear slot for releasably securing the indicator plate to a face of the adapter plate, a projection from the indicator plate operatively engaging the control cage for displacement thereof in a curvilinear path with the control cage, and indications for defining the position of the control cage.

8. In a bladed centrifugal blasting wheel, a pair of front and back wheel plates interconnected in spaced parallel relation with each wheel plate having a central opening, a plurality of crosswise aligned grooves in the inner faces of said front and back wheel plates extending radially in equally circumferentially spaced apart relation from the central opening, a blade for each pair of aligned grooves dimensioned to have a width slidably to be received between said pair of crosswise aligned grooves and dimensioned to have a length to enable insertion into said crosswise aligned grooves through said central opening, means releasably holding the blades within said crosswise aligned grooves when in position of use between said front and back wheel plates, said means comprising lugs extending laterally from the inner end portions of the blades for a distance greater than the spaced relation between the bases of the crosswise aligned grooves whereby the lugs engage the inner periphery of the front and back plates when the blades are inserted in position of use, an impeller in the form of a vaned cylindrical member mounted within the central opening for rotational movement with the wheel plates, a stationary cage in the form of a cylindrical section extending into the central opening between the impeller and the wheel plates, at least one feed slot through the cylindrical section through which particulate material is displaced from the impeller onto the inner ends of the blades, an annular centering notched flange integral with the impeller and extending radially outwardly from a rearward portion thereof for a distance less than the central opening in the back wheel plate but more than the distance between the central opening less the length of the blade lugs.

9. In a bladed centrifugal blasting wheel, a pair of front and back wheel plates interconnected in spaced parallel relation with each wheel plate having a central opening, a plurality of crosswise aligned grooves in the inner faces of said front and back wheel plates extending radially in equally circumferentially spaced apart relation from the central opening, a blade for each pair of aligned grooves dimensioned to have a width slidably to be received between said pair of crosswise aligned grooves and dimensioned to have a length to enable insertion into said crosswise aligned grooves through said central opening, means releasably holding the blades within said crosswise aligned grooves when in position of use between said front and back wheel plates, an impeller in the form of a vaned cylindrical member mounted within the central opening for rotational movement with the wheel plates, a stationary cage in the form of a cylindrical section extending into the central opening between the impeller and the wheel plates, at least one feed slot through the cylindrical section through which particulate material is displaced from the the impeller onto the inner ends of the blades, a hub to which the impeller and wheel plate are joined for conjoint rotational movement, power means for rotating the hub, a ring member secured to the outer face of the hub and fan blades extending rearwardly substantially perpendicular from the ring member and creating an air flow for blowing particulates away from the hub area.

10. An impeller for a bladed centrifugal blasting wheel comprising a tubular member having a plurality of axially disposed outwardly extending vanes and a ring member extending outwardly integrally from the outer end portion of the tubular member, and equally spaced apart grooves in the outer periphery of the ring member dimensioned to receive portions of the inner ends of the blades for rotational movement therewith.

* * * * *